United States Patent [19]

McCoy

[11] 4,454,039

[45] Jun. 12, 1984

[54] FRAME AND COVER MEMBERS FOR CONSTRUCTING APERTURES IN ROAD SURFACES

[76] Inventor: Archibald H. R. McCoy, R.R. No. 1, Troy, Ontario, Canada

[21] Appl. No.: 399,435

[22] Filed: Jul. 19, 1982

[51] Int. Cl.³ ..... E02D 29/14

[52] U.S. Cl. ..... 210/164; 210/239; 404/4

[58] Field of Search ..... 210/163, 164, 251, 239; 404/4, 5, 25, 26; 340/686

[56] References Cited

U.S. PATENT DOCUMENTS

| | | | |
|---|---|---|---|
| 497,388 | 5/1893 | Ross | 210/164 |
| 638,691 | 12/1899 | Banwell | 210/163 |
| 768,194 | 8/1904 | Pierce | 210/163 |
| 988,667 | 4/1911 | Schodde | 210/163 |
| 1,744,276 | 1/1930 | Merriman | 340/686 |
| 1,766,621 | 6/1930 | Fleming | 210/239 |
| 1,960,806 | 5/1934 | Cohen | 210/163 |
| 2,119,923 | 6/1938 | McIntyre | 210/164 |
| 2,576,353 | 11/1951 | Nelson | 404/25 |
| 2,889,928 | 6/1959 | Sisk | 210/163 |
| 3,891,337 | 6/1975 | McCoy | 404/26 |
| 4,136,010 | 1/1979 | Pilié et al. | 404/25 |
| 4,192,625 | 3/1980 | Peletz | 404/5 |
| 4,203,686 | 5/1980 | Bowman | 210/164 |

FOREIGN PATENT DOCUMENTS

| | | | |
|---|---|---|---|
| 258974 | 8/1963 | Australia | 210/164 |
| 2821724 | 11/1979 | Fed. Rep. of Germany | 210/164 |
| 661910 | 7/1929 | France | 404/25 |
| 2256990 | 9/1975 | France | 404/4 |
| 102164 | 7/1941 | Sweden | 210/164 |
| 2080355 | 2/1982 | United Kingdom | 210/163 |

OTHER PUBLICATIONS

Neenah Foundry Company, Construction Castings Catalog (1969), pp. 46, 47, 63, 68 and 72.

McCoy Foundry Company, Catalog (Feb. 1974), Sheet HM 311.

*Primary Examiner*—Benoit Castel

*Assistant Examiner*—Wanda L. Millard

*Attorney, Agent, or Firm*—Ridout & Maybee

[57] ABSTRACT

A frame member for road surface installations has a rectangular frame with a circular opening to receive circular cover members which can be used for catch basins, for manholes, and other road surface aperture covers e.g. valve chamber covers. The circular cover member may be imperforate, or perforate, with openings or with slots. A standardized frame member may be employed with various forms of structurally distinct cover members, so that a stock of standardized frames and various distinct cover members can be provided. An annular seat surface on the frame member and the matching surface on the cover member which is received on the seat surface can be machined surfaces that will fit accurately so that the cover member will not wobble relative to the frame member and is exposed to less risk of fracture.

7 Claims, 9 Drawing Figures

FRAME AND COVER MEMBERS FOR CONSTRUCTING APERTURES IN ROAD SURFACES

The invention relates to frame and cover members for constructing road surface apertures such as catch basins, manholes, valve chamber covers, and covers for underground vaults housing telephone equipment and the like. The most commonly employed form of curbside catch basin has a rectangular frame with a rectangular opening receiving a rectangular catch basin grating. Also known are catch basins having circular frames with a circular opening receiving a circular catch basin grating, but these are not well suited for curbside installation, as only a small part-circular segment of the catch basin extends into the region of the channel adjacent the curb, where most of the surface water runs, and therefore there is a tendency for the curbside stream of water to bypass the grating and not be collected. One problem with the rectangular form of catch basin grating, is, however, that normally these are formed as metal castings, usually of cast iron, and as a result of casting imperfections, and because of warpage or shrinkage during cooling or the casting, the cast grating will often not fit perfectly evenly within the rectangular frame, but tends to wobble within the frame when a car or truck tire passes over it. Apart from the nuisance of the rattling sound which accompanies the wobble, there is the risk that the grating or the frame can fracture, which can present a hazard in the road surface, and necessitates replacement. Problems of poor fit between the grating and the frame can be reduced by machining the interengaging surfaces, which also relieves stresses in the casting as it takes off the harder crust of the casting and allows the softer inside to relieve, thus making it less susceptible to fracture, but the machining of rectangular edges is a difficult, time consuming and expensive operation.

In contrast, installations which are to be sited in or adjacent the centre of the road i.e. other than curbside installations, are more usually formed with circular frames and circular gratings or covers. Again, these are usually formed of iron or other metal castings, but the circular form of the grating or other cover is better adapted to withstand the heavy traffic loads likely to be encountered in a mid-road installation, as the stress tends to be distributed evenly throughout the structure without being concentrated at angularities or corners, and any imperfections at the annular zone of interengagement between the edge of the cover and the frame can readily be removed by machining. In some forms of installation, it is desired to provide a gas-tight or water-tight closure between the cover and the frame, and the circular configuration lends itself particularly well to the addition of gasketing and other sealant materials, and the manufacture of gasketing materials in an annular configuration is itself relatively simplified as compared with other geometric configurations.

Up to the present time, a wide variety of configurations of frames, cover members and gratings for roadway installations has been proposed, but none of the elements of the structures employed for curbside installation have been interchangeable with those employed in mid-road installation. Even among the specialized types of installation themselves, for example in the case of manholes, numerous strikingly different configurations and designs of frame member-cover member combinations are currently made available, and there is no standardization of the design of the individual cover members or frame members, so that the cover or frame members of one design can not be employed interchangeably with the corresponding member from other designs of manhole. The criticism can therefore be levelled against existing arrangements that there is much redundant diversification of the designs of cover members and frame members, which ultimately leads to an increased cost being borne by the users of these roadway installation members.

The object of the present invention is to provide frame members and cover members whereby the above-noted and other disadvantages of the known frame and cover members may be avoided.

In the present invention, there is employed a one-piece cast metal frame member having an upper generally rectangular plate portion with a generally planar upper face. Side walls are formed integrally with the upper plate portion and extend downwardly therefrom to a base portion comprising a flange formed integrally with and extending laterally outwardly from the lower portion of the side walls. In the upper plate portion, a circular aperture is formed, which is provided with support means for supporting a circular cover member when inserted in the aperture. This frame member is capable of receiving any one of a number of different forms of cover member, each sized so as to fit snugly and interchangeably within the circular aperture of the frame member. Thus, the circular cover member can be a slotted or other perforated grating, permitting the frame member with a circular grating to be employed as a curbside catch basin. The circular cover member may be one or more of various styles of manhole cover, valve chamber cover, or other styles of generally-known roadway aperture cover. In the case that the arrangement is used as a curbside catch basin, the arrangement can if desirable or necessary be installed with the rectangular frame recessed below the level of the road surfacing, so as to provide a relatively large rectangular recessed catchment area interrupting the curbside channel and which will efficiently serve to collect surface water flowing along the curb channel.

The present arrangement thus permits the provision of a standardized rectangular frame which can be used interchangeably with a variety of structurally distinct circular cover members. A stock of these frame members can thus be provided, together with a stock of mutually structurally distinct cover members, which can be used for constructing road surface apertures of varying types, thus permitting considerable economies to be achieved by the manufacturer and by the users of these structures, as the need for the latter to maintain a large inventory of structurally distinct frame members is eliminated.

In one aspect, the invention provides a stock of road surface aperture frame and cover members comprising: a plurality of substantially identical frame members each being a one piece metal casting having an upper generally rectangular plate portion having a generally planar upper face, side walls formed integrally with the upper plate portion and extending downwardly therefrom a base portion comprising a flange formed integrally with and extending laterally outwardly from the lower portion of the side walls, and a circular aperture through the upper plate portion provided with support means for supporting a circular cover member when inserted in the aperture; and in combination therewith a plurality of mutually structurally distinct circular cover members each sized to fit snugly and interchangeably within the aperture of each said frame member.

In a further aspect, the invention provides a catch basin comprising a one-piece cast metal frame member generally rectangular in plan and having a generally rectangular and planar upper face, side walls formed integrally with and extending downwardly from the sides of the upper face, a base portion comprising a flange formed integrally with and extending laterally outwardly from the lower portion of the side walls, a circular aperture in the upper face, an annular lip extending inwardly around the periphery of the aperture and offset downwardly from the upper face, the lip having its upper side machined to form a smooth generally planar annular surface generally parallel to said upper face; and a circular cast metal catch basin grating formed with an array of openings therethrough and fitting snugly within the aperture in the frame member and having an annular lower peripheral edge portion machined to form a smooth generally planar annular surface for seating on said machined lip upper annular surface. In the catch basin gratings, the openings through the grating, normally in the form of relatively large slots, impart a degree of asymmetry to the structure, thus making it particularly prone to problems of warpage and shrinkage during the casting process. By machining the interengaging surfaces of the grating and the frame, e.g. by grinding, a good stable fit of the grating within the aperture can be achieved, and internal stresses can be relieved, avoiding problems of wobble of the grating relative to the frame and reducing the risks of breakage of the structure in service. The periphery of the grating seats firmly on an underlying lip surface, eliminating or reducing the risk of the grating becoming flipped upwardly when a car or truck tire runs over the grating.

The invention will now be more fully described, by way of example only, with reference to the accompanying drawings, in which.

Figure 1:
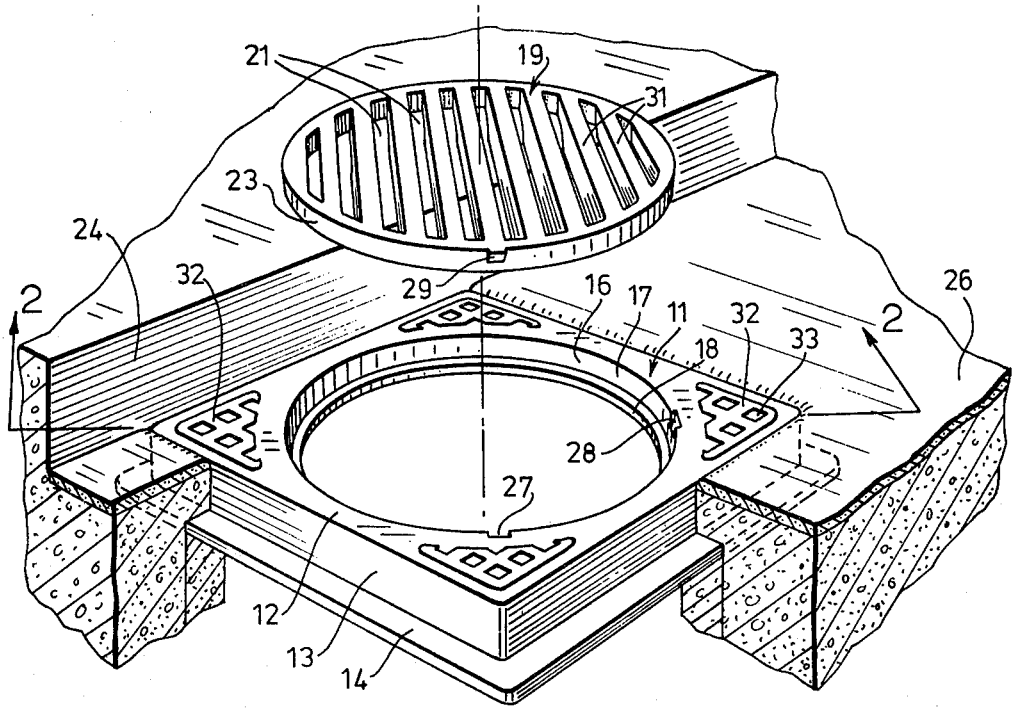
FIG. 1 shows a perspective view, partly in section and partially exploded, of a frame and catch basin grating installed at a curbside.

Referring to the drawings FIG. 1 shows a frame 11 which is a one-piece casting of metal, usually iron. The casting is generally rectangular in plan and in the preferred form, as shown, is square in plan. The casting consists of a square upper late portion 12. Side walls 13 are formed integrally with and depend downwardly from the side walls of the plate portion 12. The walls 13 slope slightly outwardly, and define a generally square cavity beneath the plate portion 12. The side walls 13 terminate in a horizontal base portion in the form of a horizontal outwardly extending flange 14 cast integrally with the lower sides of the side walls 13. The upper plate portion 12 is cast with a circular aperture 16 through it, and opening into the rectangular cavity. The aperture 16 is bordered by a circular side wall 17, the outer and inner surfaces of which taper slightly inwardly in the downward direction. The side wall 17 terminates in an integrally-cast annular inwardly-extending lip 18 providing an annular horizontal upper face or seat.

Figure 2:
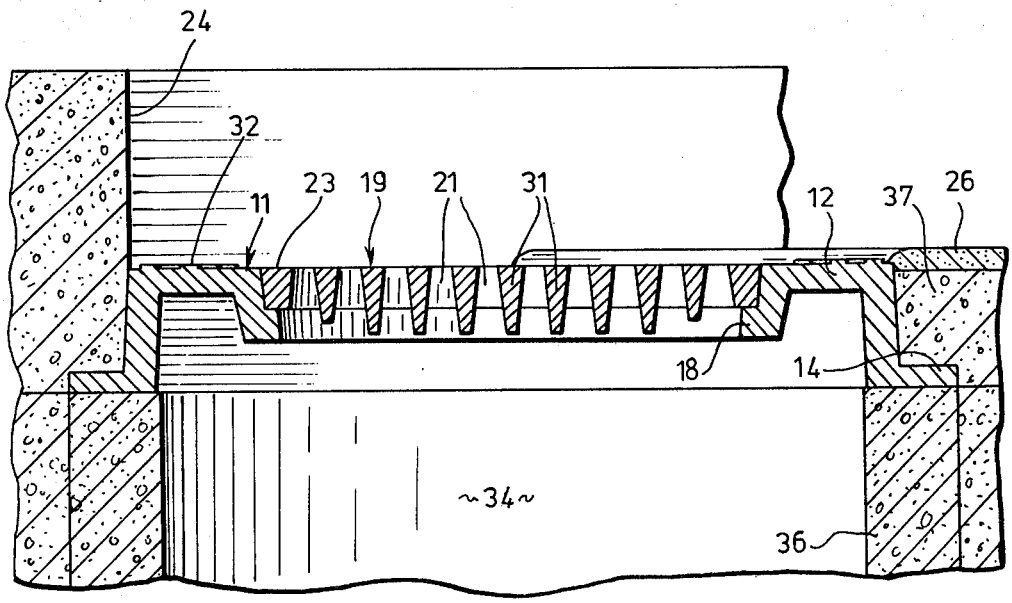
FIG. 2 shows a section taken on the line 2—2 in FIG. 1, and showing a road surfacing material defining a recess about the periphery of the frame, and with the grating seated in the frame.

In the examples shown in FIGS. 1 and 2, the frame 11 is used in the construction of a curbside catch basin, and the circular cover member received in the opening 16 is in the form of a circular catch basin grating 19. The grating 19 is also formed as a one-piece casting and has an array of parallel slot openings 21. As best seen in FIG. 2, the outer side of the grating 19 tapers inwardly in the downward direction, to match the taper of the inner side of the side wall 17 of the opening in the frame 11.

The underside of the annular rim 23 of the grating 19 and the annular upper side or seat side of the lip 18 are machined, e.g. by a conventional grinding operation, with the advantages noted above, to make these surfaces as far as possible perfectly planar. As the grating 19 is confined within the downwardly extending wall 17 bordering the aperture in the frame, and is supported from beneath with its smooth machined rim surface engaging the smooth machined upper seat surface of the lip 18, there is little or no tendency for the grating to flip upwardly relative to the frame 11 when a heavy automobile or truck tire passes over the grating.

In use, as shown in FIG. 1, the frame member 11 is positioned with one side of the upper plate portion 12 aligned with the curb 24 to be constructed at the side of the roadway. The road surfacing material e.g. a surface layer of asphalt 26 is applied so that it does not extend over the upper surface of the upper plate portion 12, but may if necessary or desirable form a raised square border around the other three sides of the plate portion 12, with the upper surface of the plate portion 12 being recessed below the plane of the upper surface of the surfacing material 26. A relatively large square recessed catchment area is thus provided in the road surface adjacent the curb 24. In order to improve the hydraulic flow-collecting properties of the grating 19, it is desirable to arrange the grating 19 so that the slots 21 are angled at approximately 45° relative to the curb 24 and are oriented relative to water flow along the curb so that the water is directed in toward the curb 24. Thus, in installations where the gradient of the road results in the flow of water along the curb 24 approaching the grating 19 from the lower left side, as seen in FIG. 1, the grating is desirably arranged with the slots 21 forming an acute angle with the portion of the curb 24 at the left hand side of the grating 19, as seen in FIG. 1, and where the slope of the road is downwards in the direction from right to left as seen in FIG. 1, so that the flow of water approaches the catch basin from the upper right hand side, as seen in FIG. 1, desirably the grating 19 is arranged in a position rotated through 90° as compared with that shown in FIG. 1, so that the slots 21 form an acute angle of about 45° with the portion of the curb 24 extending rightwardly from the catch basin. Advantageously, the grating 19 and the periphery of the aperture 16 in the frame 11 are formed with interengaging lugs and notches for locating the grating 19 relative to the frame 11 selectively in either of these two positions.

In the example shown in FIGS. 1 and 2, the side wall of the aperture 16 in the frame 11 is formed with a pair of notches 27 and 28 adjacent respective corners of the frame member 11 and angularly spaced at about 90°. The rim 23 of the grating 19 is formed with a single radially projecting lug 29 which can be engaged selectively with either of the notches 27 and 28, thus locating the grating 29 in the desired orientation relative to the curb 24.

From FIG. 2, it will be noted that the parallel bars 31 defining the slot openings 21 in the grating are formed to be of greater depth adjacent the centre of the grating, thus providing increased strength adjacent the centre of the grating, to make it better able to withstand loads imposed on it. The bars 31 taper downwardly in thickness, so that the slot openings 21 flare downwardly, thus reducing the risk of the grating openings becoming blocked through materials becoming jammed in the slot openings 21.

Adjacent the corners of the upper plate portion 12, the upper surface of the casting is formed with raised triangular portions 32 each formed with a series of square and part rectangular indentations 33, to provide an anti-slip surface to reduce the risk of vehicle tires skidding on the metal surface.

In the construction of the roadway, including the catch basin or other surface aperture, the frame 11 will normally be positioned over a shaft or vault 34, leading to an underground drainage system, or giving access to sub-surface installations. The base portion provided by the horizontal flange 14 rests on a generally horizontal surface provided by an upper edge of a vault side wall 36. The side wall 36 may be formed of bricks, blocks, or may be a concrete casting as shown. The frame 11 is secured in place by grout 37 applied around the side walls 13 of the frame. If desirable or necessary, the upper surface of the plate portion 12 of the frame may be left standing slightly proud of the upper surface of the surrounding grout 37, as shown in FIG. 2, so that the protruding upper edge of the side wall 13 can serve to resist any tendency for the raised border of asphalt or other road surfacing material 26 to flow or creep laterally over the upper surface of the frame 11.

It will be noted that the frame 11 has each of its side walls 13 of uniform depth and that the lower side of the flange 14 of the base portion has a generally planar lower surface which is generally parallel to the plane of the upper surface of the plate portion 12. This renders the frame 11 capable of use not only in the construction of catch basins, but also for various other forms of roadway installations.

Figure 3:
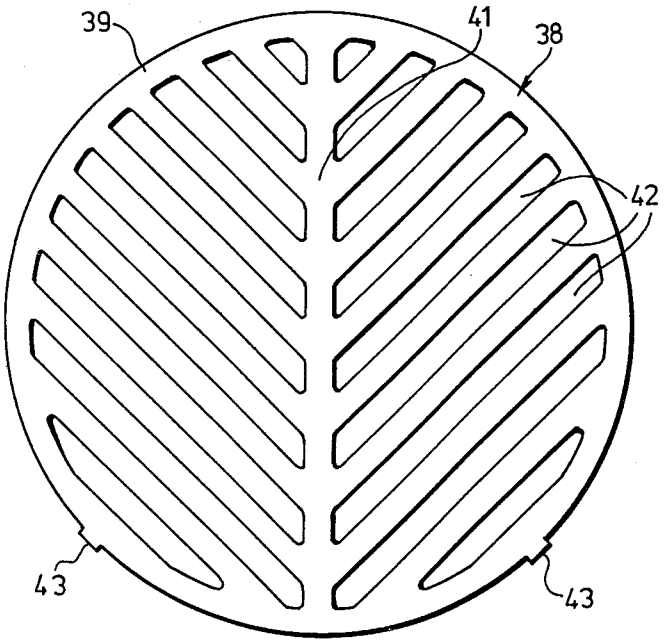
FIG. 3 shows a plan view of an alternative style of catch basin grating.

FIG. 3 shows an alternative configuration of catch basin grating 38, having an annular rim 39, and a central bar 41 coincident with a diameter of the rim 39. The grating is symmetrical about this diameter, and has two sets of slots 42. The two sets of slots each extend from the rim 39 to the central bar 41 and the slots in each set are parallel and incline at the same angle from the rim 39 toward one end of the bar 41. The herringbone pattern of relatively narrow slots 42 provides a bike-proof grating, whereby the slots 42 can in use be set at an angle to the curb so that narrow bicycle wheels are not caught in the slots. The rim 39 of the grating is formed with the same external diameter and thickness as that of the grating 19 of FIGS. 1 and 2, so that the grating 38 can be used interchangeably with the grating 19. The rim 39 is formed with two radially protruding projections 43 spaced angularly at 90° and adapted to engage with the notches 27 and 28 in the frame 11. It will be appreciated that, for the best hydraulic collection properties, the frame 11 should be set in place alongside the curb 24, but with the notches 27 and 28 arranged adjacent the curb 24 i.e. with the frame 11 turned through 180° relative to its position shown in FIG. 1, so that when the lugs 43 engage the notches 27 and 28, the end of the bar 41 toward which the slots 42 incline is positioned approximately midway along the side of the plate portion 12 adjacent the curb 24 and the slots 42 define acute angles of approximately 45° with the adjacent portions of the curb 24.

As discussed above, the present arrangement permits a common form of frame to be used in the construction of various forms of road surface aperture, the same or common form of frame being useable interchangeably with various structurally distinct forms of cover member intended for various purposes, so that the users of these structures can be provided with a stock of frame members and various styles of cover members from which they can select combinations of cover members and frame members adapted for the particular purpose. In use, the frame and cover members can be incorporated into the road surface at any desired location e.g. in the sidewalk or at various positions in the road. Some further examples of the various forms of cover member that can be used are shown in FIGS. 4 through 9. Each of these cover members can be used interchangeably in the frames 11 illustrated in FIGS. 1 and 2.

Figure 4:
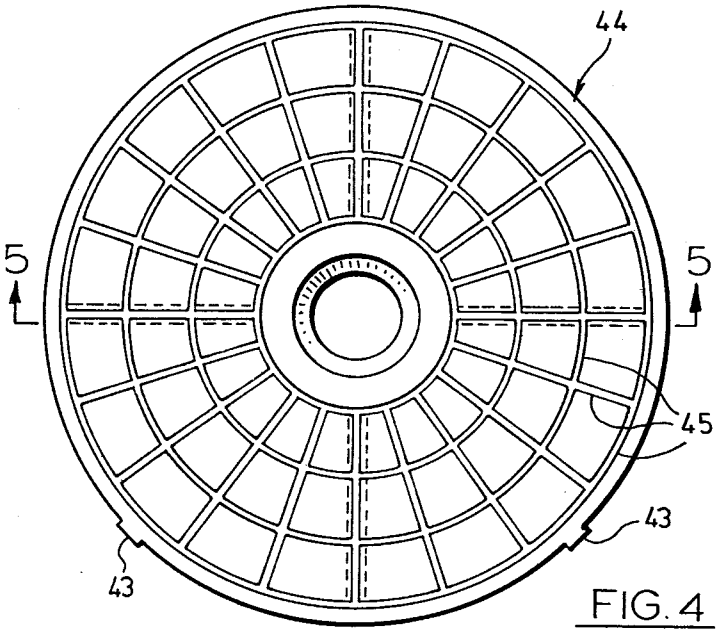
FIG. 4 shows a plan view of a valve chamber cover.
Figure 5:
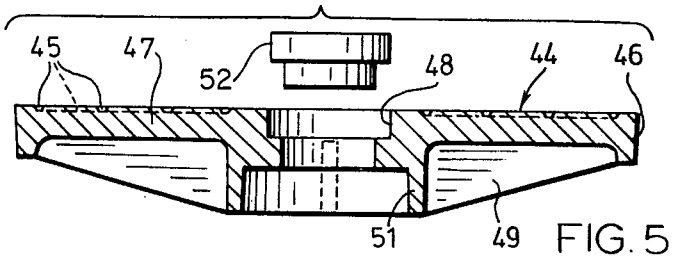
FIG. 5 shows a section on the line 5—5 in FIG. 4.

FIG. 4 shows a valve chamber cover 44 having an anti-slip pattern of radial and circumferential grooves 45 on its upper surface. The cover has a relatively thick annular rim portion 46, and a main circular portion 47 of reduced thickness and formed with a stepped aperture 48 through the centre of the cover. In order to provide the casting with greater strength, on its underside it is formed with four regularly spaced strengthening ribs 49 extending radially from a downwardly depending thick walled sleeve 51 bordering the underside of the aperture 58 and extending radially to the inner side of the rim 46. A stepped cast metal plug 52 is normally received within the aperture 48. This type of cover is employed in installations where it is desired to have access to underground valving e.g. main water valves within the underground vault on which the frame member is laid. The plug 52 can be lifted from the aperture 48 to allow tools to be inserted through the aperture 48 to operate the underground valving, and the entire cover 44 can be lifted when it is desired to have access to the underground valving for servicing. Desirably the opening 16 through the standardized frame 11 is sufficiently large that an operator can freely pass through the opening to gain access to the underground vault. Merely by way of example, it may be mentioned that the opening at the lip 18 may be about 22 inches in diameter. The upper plate portion 12 may be about 27 inches square, and the side wall 13 about 6 inches deep, with the flange 14 projecting about 2½ inches from the side wall 13.

Figure 6:
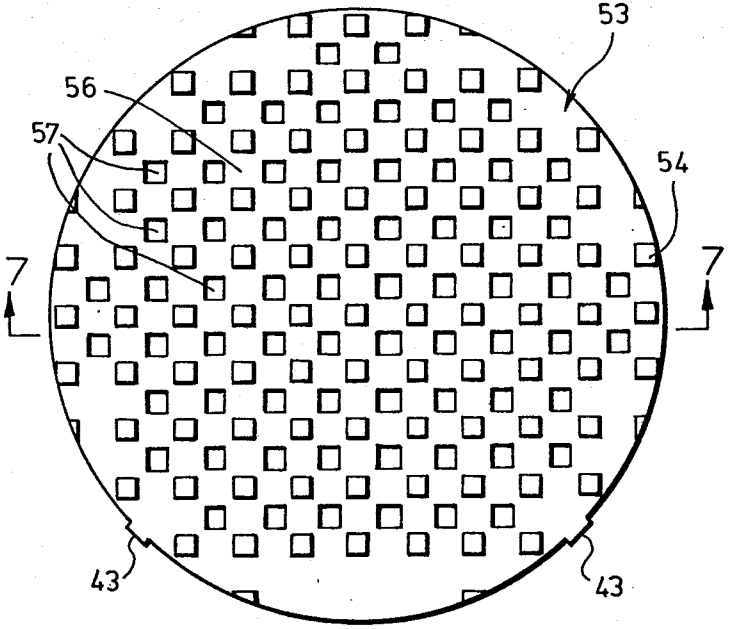
FIG. 6 shows a plan view of a perforated manhole cover.
Figure 7:
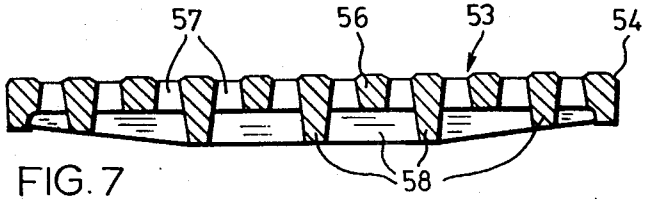
FIG. 7 shows a section on the line 7—7 of FIG. 6.

FIGS. 6 and 7 show a cast metal perforated manhole cover 53 having a relatively thick annular rim 54 and a main portion 56 of reduced thickness perforated at intervals with downwardly flaring openings 57. The underside of the casting is formed with a grid of longitudinally and transversely extending bars 58 cast integrally with the main portion 56 and the rim 54, to provide added strength.

Figure 8:
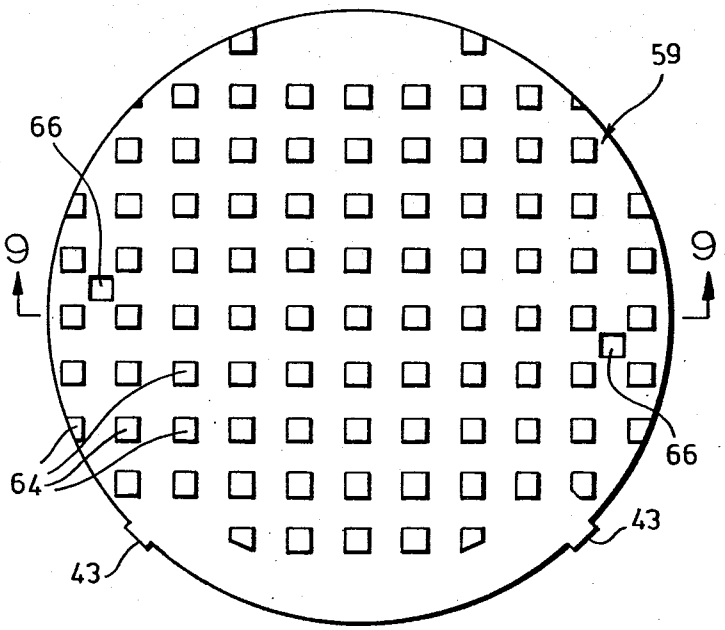
FIG. 8 shows a plan view of an imperforate manhole cover.
Figure 9:
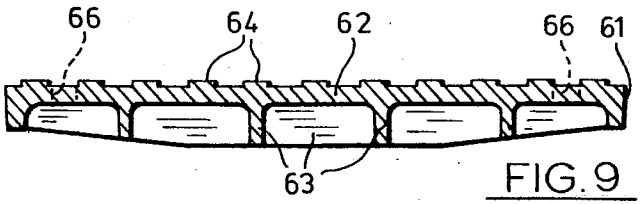
FIG. 9 shows a section taken on the line 9—9 in FIG. 8.

FIGS. 8 and 9 show a mainly imperforate manhole cover 59 again having a relatively thick annular rim 61 and a generally imperforate main portion 62 of reduced thickness. The underside is again strengthened through integrally-cast longitudinally and transversely extending bars 63 and the upper surface may be formed with raised studs 64 or other anti-slip surface discontinuities. In the example shown, the main portion 62 of the cover is formed with two small apertures 66 through which lifting tools can be inserted to facilitate lifting the cover 59 when servicing is needed to be carried out within the underground vault underlying the cover.

Other forms of cover member can of course be employed. For example, the cover member may be generally as shown in FIGS. 8 and 9, but may be entirely imperforate, and may be provided with recessed blind or closed pockets in its upper surface to engage lifting tools to facilitate lifting the cover from the frame. In order to obtain a completely sealed closure of the below-ground vault, a closed manhole cover as described above may be employed with an annular gasket which is interposed between the annular rim of the cover and the annular upper seating surface of the lip 18 on the frame member 11. The lip 18 may be formed with integrally-cast inwardly extending lugs spaced regularly around the inner periphery of the lip 18, these lugs being provided with threaded holes which receive the threaded ends of bolts passed through correspondingly-spaced apertures adjacent the periphery of the cover member to clamp the gasket tightly between the rim of the cover member and the upper seating surface of the lip 18, and provide a gas-tight seal.

In all cases, the various cover members constituting the stock of interchangeable cover members, are formed to have an external diameter such that they fit snugly within the aperture in the common frame member 11. Normally in each case, the rim portion of the cover member is formed so that, when seated on the upper seating surface of the lip 18 of the frame at least the edge portion of the cover member is flush with the adjacent edge of the upper plate portion 12 of the frame bordering the aperture 16. Desirably, in each case, the underside of the rim portion of the cover member e.g. the underside of the rims 38, 46, 54 and 61 of the various styles of cover member illustrated in FIGS. 3 through 9 is machined to provide a smooth generally planar surface which will seat evenly on the machined upper seating surface of the lip 18.

Desirably, each of the cover members is formed with at least one lug on its periphery to engage the notch 27 or 28 in the frame to locate the cover member nonrotatably relative to the frame and resist any tendency for the cover member to be spun about its axis by reaction with a vehicle tire. Where, as in the case of the cover members illustrated by way of example in FIGS. 3 to 9 there is no necessity for the cover members to be positionable in more than one orientation relative to the frame 11, desirably each cover member is provided with two of the lugs 43 as shown, positioned to engage the notches 27 and 28 respectively.

The form of frame 11 illustrated in the drawings is also well adapted to be used with the elevating band which is the subject of my U.S. Pat. No. 3,891,337 dated June 24, 1975, to which reference should be made for further details. This permits cover members such as the cover members illustrated in FIGS. 4 through 9 of the accompanying drawings to be supported in elevated relationship relative to the frame 11, so that when a road is resurfaced, it is possible to raise the level of the cover member to make this flush with the level of the new road surface without needing to change the position of the frame 11. In the case in which the manhole cover or other cover member has lugs such as the lugs 43, the elevating band described in the above-mentioned U.S. patent may be modified to provide it on its inner surface with notches similar to the notches 27 and 28, to accomodate the lugs 43.

I claim:

1. A catch basin comprising a one-piece cast metal frame member generally rectangular in plan and having a generally rectangular and planar upper face, side walls formed integrally with and extending downwardly from the sides of the upper face, a base portion comprising a flange formed integrally with and extending laterally outwardly from the lower portion of the side walls, a circular aperture in the upper face, an annular lip extending inwardly around the periphery of the aperture and off set downwardly from the upper face, the lip having its upper side machined to form a smooth generally planar annular surface generally parallel to said upper face; and a circular catch basin grating fitting snugly within the aperture in the frame member and having an annular lower peripheral edge portion machined to form a smooth generally planar annular surface for seating on said machined lip upper annular surface, the grating comprising a one piece metal casting having an annular rim, a central bar coincident with a diameter of the rim and integrally joined at each end with said rim, and the grating being symmetrical about said diameter and having two sets of slots extending from the rim to the central bar, the slots in each set being parallel and inclining at the same angle from the rim toward one end of the bar and being defined between side bar members each of which is at one end integrally joined with said annular rim and at the opposite end is integrally joined with the central bar.

2. A catch basin as claimed in claim 1 wherein the side walls of the frame member are of uniform length and the lower edges of the side walls and the bottom surface of the flange are generally parallel to the plane of the upper face.

3. A catch basin as claimed in claim 1 provided with interengaging means wherein the periphery of one of said grating and said circular aperture in the frame member is formed with at least one radially extending notch, and the other has at its periphery at least one radially extending lug for engaging the notch.

4. A catch basin as claimed in claim 3 wherein there are two of said notches spaced apart around said periphery at an angular spacing of about 90°.

5. A catch basin as claimed in claim 1 wherein the frame member is formed with anti-slip surface discontinuities on its upper surface adjacent each corner thereof.

6. A catch basin as claimed in claim 1, wherein the grating has two lugs on its periphrey arranged so that when the lugs engage said two notches, the end of said central bar remote from said one end is positioned approximately midway along one of the sides of the rectangular upper face.

7. A catch basin as claimed in claim 4 comprising two lugs engaging said notches, respectively, and wherein said central bar of the grating extends parallel to one side of the rectangular frame and each set of slots extends at an angle of about 45% with respect to the side of the rectangular frame adjacent to it.

* * * * *